US010980684B2

(12) United States Patent
Gallingani et al.

(10) Patent No.: US 10,980,684 B2
(45) Date of Patent: Apr. 20, 2021

(54) WHEELCHAIR LIFT WITH HIGH STABILITY

(71) Applicant: Autolift S.r.l., Pegognaga-Mantova (IT)

(72) Inventors: Marco Gallingani, Reggio Emilia (IT); Gabriele Ovi, Reggio Nell'Emilia (IT)

(73) Assignee: Autolift S.r.l., Pegognaga-Mantova (IT)

( * ) Notice: Subject to any disclaimer, the term of this patent is extended or adjusted under 35 U.S.C. 154(b) by 0 days.

(21) Appl. No.: 16/578,675

(22) Filed: Sep. 23, 2019

(65) Prior Publication Data

US 2020/0093660 A1 Mar. 26, 2020

(30) Foreign Application Priority Data

Sep. 25, 2018 (EP) ..... 18196589

(51) Int. Cl.
*A61G 3/06* (2006.01)

(52) U.S. Cl.
CPC ..... *A61G 3/062* (2013.01)

(58) Field of Classification Search
CPC ..... A61G 3/062; A61G 3/061; B60P 1/4414; B60P 1/4407; B60P 1/4457; B60P 1/44
See application file for complete search history.

(56) References Cited

U.S. PATENT DOCUMENTS

| | | | | |
|---|---|---|---|---|
| 8,042,655 | B1 | 10/2011 | Ablabutyan et al. | |
| 9,149,397 | B2 * | 10/2015 | Gallingani | A61G 3/062 |
| 9,375,369 | B2 * | 6/2016 | Bruns | A61G 3/062 |
| 9,814,635 | B2 * | 11/2017 | Bruns | A61G 3/062 |
| 9,814,643 | B2 * | 11/2017 | Reid | A61G 3/062 |
| 9,974,702 | B2 * | 5/2018 | Gallingani | A61G 3/062 |
| 10,117,795 | B2 * | 11/2018 | De Rossi | A61G 3/062 |
| 10,195,977 | B2 * | 2/2019 | Bettcher, III | B60P 1/4457 |
| 10,426,673 | B2 * | 10/2019 | Budd, II | B60P 1/4492 |
| 10,485,716 | B2 * | 11/2019 | Yang | A61G 3/0808 |
| 2019/0038482 | A1 * | 2/2019 | Kline | A61G 3/062 |
| 2020/0054506 | A1 * | 2/2020 | Gallingani | F15B 11/048 |

FOREIGN PATENT DOCUMENTS

| | | |
|---|---|---|
| GB | 2 491 378 A | 12/2012 |
| WO | 99/60976 A1 | 12/1999 |

* cited by examiner

*Primary Examiner* — Kaitlin S Joerger
(74) *Attorney, Agent, or Firm* — Collard & Roe, P.C.

(57) ABSTRACT

A wheelchair lift includes a platform assembly to receive a wheelchair, and a lifting assembly to move the platform assembly, a supporting plate to support the lifting assembly, and a supporting arm to support the platform assembly. The lifting assembly includes a pair of a first lifting arm and a second lifting arm. The first lifting arm has a bent shape along the longitudinal direction of the first lifting arm, and the second lifting arm has a bent shape along the longitudinal direction of the second lifting arm.

14 Claims, 15 Drawing Sheets

WHEELCHAIR LIFT WITH HIGH STABILITY

CROSS REFERENCE TO RELATED APPLICATIONS

Applicant claims priority under 35 U.S.C. § 119 of European Application No. 18196589.8 filed Sep. 25, 2018, the disclosure of which is incorporated by reference.

BACKGROUND OF THE INVENTION

1. Field of the Invention

The disclosure relates to a wheelchair lift which enables a wheelchair to be lifted from a ground level position to an entry level position in a vehicle and inversely to be lifted from an entry level position to an ground level position.

2. Description of the Related Art

Vehicular wheelchair lifts are utilized to facilitate lifting of wheelchairs into a vehicle. The wheelchair lift comprises a platform assembly having at least one plate to load a wheelchair. The platform assembly may be moved by a power control assembly between a stowed position in which the platform assembly and other components of the wheelchair are collapsed, an entry level position and a ground level position. In the entry level position, the platform assembly is in an unfolded configuration so that a wheelchair placed in a vehicle can be loaded from the floor of the vehicle onto the platform assembly. When the wheelchair lift is in the ground level position, the platform assembly is still unfolded and coplanar to the ground outside the vehicle so that a wheelchair placed on the platform assembly can be unloaded from the platform assembly.

FIG. 1A shows a conventional embodiment of a wheelchair lift comprising a platform assembly 10 having two plates 11 and 12 to load a wheelchair. The wheelchair lift further comprises a lifting assembly 20 to lift the platform assembly 10 between the stowed position, the entry level position and the ground level position. FIG. 1A shows the platform assembly in an unfolded configuration. The platform assembly 10 is mounted to the lifting assembly 20 by a supporting assembly 40. The supporting assembly 40 comprises supporting arms of which only one supporting arm 41 is shown in FIG. 1A.

The lifting assembly 20 comprises a lifting arm 21 and a lifting arm 22. The lifting arms are moved by the power control assembly 30 comprising a pump and a hydraulic cylinder 31 being part of a hydraulic drive system. The lifting arm 21 is rotatably coupled to a mounting point 41 of the supporting arm 41 and to a mounting point 51 of a supporting plate 50. The lifting arm 22 is rotatably coupled to a mounting point 42 of the supporting arm 41 and a mounting point 52 of the supporting plate 50.

As shown in FIG. 1A, the lifting arms 21 and 22 extend in a straight manner between the mounting points 41, 51 and 42, 52. FIG. 1B illustrates a section of the lifting arms 21, 22 in a cross-sectional view. The lifting arms have a U-shaped profile having a bottom area/side 23 and lateral areas/sides 24, 25. The lateral areas/sides 24 and 25 are orthogonally arranged in relation to the bottom area/side 23.

When a load is not placed in the center of the platform assembly, the lifting arms 21 and 22 tend to twist during the rising/lowering movement of the platform assembly 10. This is caused by the straight structure of the lifting arms and by the parallel arrangement of the lifting arms 21 and 22 which have an open profile. When a torsional load is executed to the straight parallel lifting arms 21 and 22, it may be observed that the shape of the lifting arms 21 and 22 starts to change.

As a result, the lifting arms 21 and 22 will twist. This is caused by the straight U-shaped profile of each of the lifting arms 21 and 22 which is too flexible to withstand the torsional load. The straight formed lifting arms 21, 22 usually just have one reinforcement rib that improves the rigidity of the lifting arms in the direction of the platform. However, this measurement is not suited to withstand a torsional moment, because the side plates/lateral areas 24 and 25 are plane and can move in-/outwards as illustrated in FIG. 1B by both arrows.

In conclusion, the U-shaped and straight profile of the lifting arms 21 and 22 being arranged in parallel between their mounting points is not suited to resist a torsional force or moment which is exerted onto the lifting arms 21 and 22, when a high load is placed on the platform assembly, and, in particular, when the load is not centrally located on the platform assembly 10.

SUMMARY OF THE INVENTION

There is a desire to provide a wheelchair lift, wherein the profiles of the wheelchair lift, and, in particular, the lifting arms withstand a high torsional force/moment so that the wheelchair lift has a high strength and stability.

An embodiment of a wheelchair lift having high stability is provided in accordance with the invention.

According to a possible embodiment, the wheelchair lift comprises a platform assembly to receive a wheelchair, a lifting assembly to move the platform assembly between an entry level position and a ground level position which is below the entry level position, a supporting plate to support the lifting assembly, and a supporting arm to support the platform assembly. The lifting assembly comprises a pair of a first lifting arm and a second lifting arm. The first lifting arm is rotatably coupled to a first mounting point of the supporting arm at a first end section of the supporting arm. The second lifting arm is rotatably coupled to a second mounting point of the supporting arm in the first end section of the supporting arm. The second mounting point is arranged in the first end section of the supporting arm closer to the platform assembly than the first mounting point.

The first lifting arm is rotatably coupled to a third mounting point at the supporting plate, and the second lifting arm is rotatably coupled to a fourth mounting point at the supporting plate. The first lifting arm has a bent or curved shape along the longitudinal direction of the first lifting arm. The second lifting arm has a bent or curved shape along the longitudinal direction of the second lifting arm.

In contrast to a conventional embodiment of a wheelchair lift, as shown for example in FIG. 1A, having a straight-shaped lifting arm, it is proposed to provide the wheelchair lift with lifting arms having a bent or curved profile along their longitudinal direction extending between the first and third mounting point or between the second and fourth mounting point.

According to a first possible embodiment of the wheelchair lift, the first and second lifting arm have a convex-shaped longitudinal profile. The first and second lifting arm respectively have a U-shaped cross-sectional profile. In particular, the first and the second lifting arm respectively have a bottom area and a first lateral area as well as a second lateral area. The first and the second lifting arms are respectively formed integrally, i.e. are made of one piece, wherein the lateral area/lateral sides are bent at angle of about 90° in relation to the bottom area. According to a possible embodiment of the wheelchair lift, the outer surface of the respective bottom area of the first and second lifting arm has a rounded shape.

Due to the U-shaped cross-sectional profile, the bottom area of the first and second lifting arm has a rounded shape between the first lateral area and the bottom area, and between the second lateral area and the bottom area. Due to the U-shaped cross-sectional profile of the lifting arms, the inner surfaces of the first and second lateral area/side and the bottom area/side of the lifting arms form a respective channel.

According to a second embodiment of the wheelchair lift, each of the first and the second lifting arm has a first portion and a second portion. The first and the second portion of the first lifting arm as well as the first and the second portion of the second lifting arm are arranged at an angle to each other such that the bent shape has an edge being formed between the respective first and second portion of the first and second lifting arm.

A welded zone may be formed between the respective first lateral area of the first portion of the first and second lifting arm and the respective first lateral area of the second portion of the first and second lifting arm. Furthermore, a respective welded zone may be formed between the respective second lateral area of the first portion of the first and second lifting arm and the respective second lateral area of the second portion of the first and second lifting arm.

In comparison to straight lifting arms, the lifting arms of the second embodiment of the wheelchair lift have an extra bending in the center of the lifting arms. As a result, the lifting arms of the second embodiment of the wheelchair lift have an increased strength and stability in comparison to the straight version of the lifting arms. Furthermore, the rigidity of the lifting arms gets higher, because the lateral areas/side plates are not free to move as in the straight version of the lifting arms.

According to the first embodiment of the wheelchair lift, the lifting arms have a bent/curved profile along the longitudinal direction of the lifting arms, and have a rounded shape of their bottom area, and have a transition area between the bottom area and the first and second lateral area, the transition area being configured as a rounded area. That means that the lifting arms of the first embodiment has three types of reinforcements which further improves strength, stability and rigidity of the lifting arms in comparison to the second embodiment of the wheelchair lift. Moreover, in comparison to the second embodiment of the wheelchair lift comprising the bent lifting arms forming an angle between the first and second portion of the lifting arms, no welding seams are necessary in the lateral areas of the lifting arms of the first embodiment of the wheelchair lift.

In conclusion, the bent or curved lifting arms have a bigger profile with lower weight and provide increased safety to withstand torsional forces/moments in comparison to the straight versions of conventional lifting arms.

It is to be understood that both the forgoing general description and the following detailed description present embodiments and are intended to provide an overview or a framework for understanding the nature and character of the disclosure. The accompanying drawings are included to provide further understanding, and are incorporated into, and constitute a part of, this specification. The drawings illustrate various embodiments and, together with the description, serve to explain the principles and operation of the disclosed concepts.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1A:
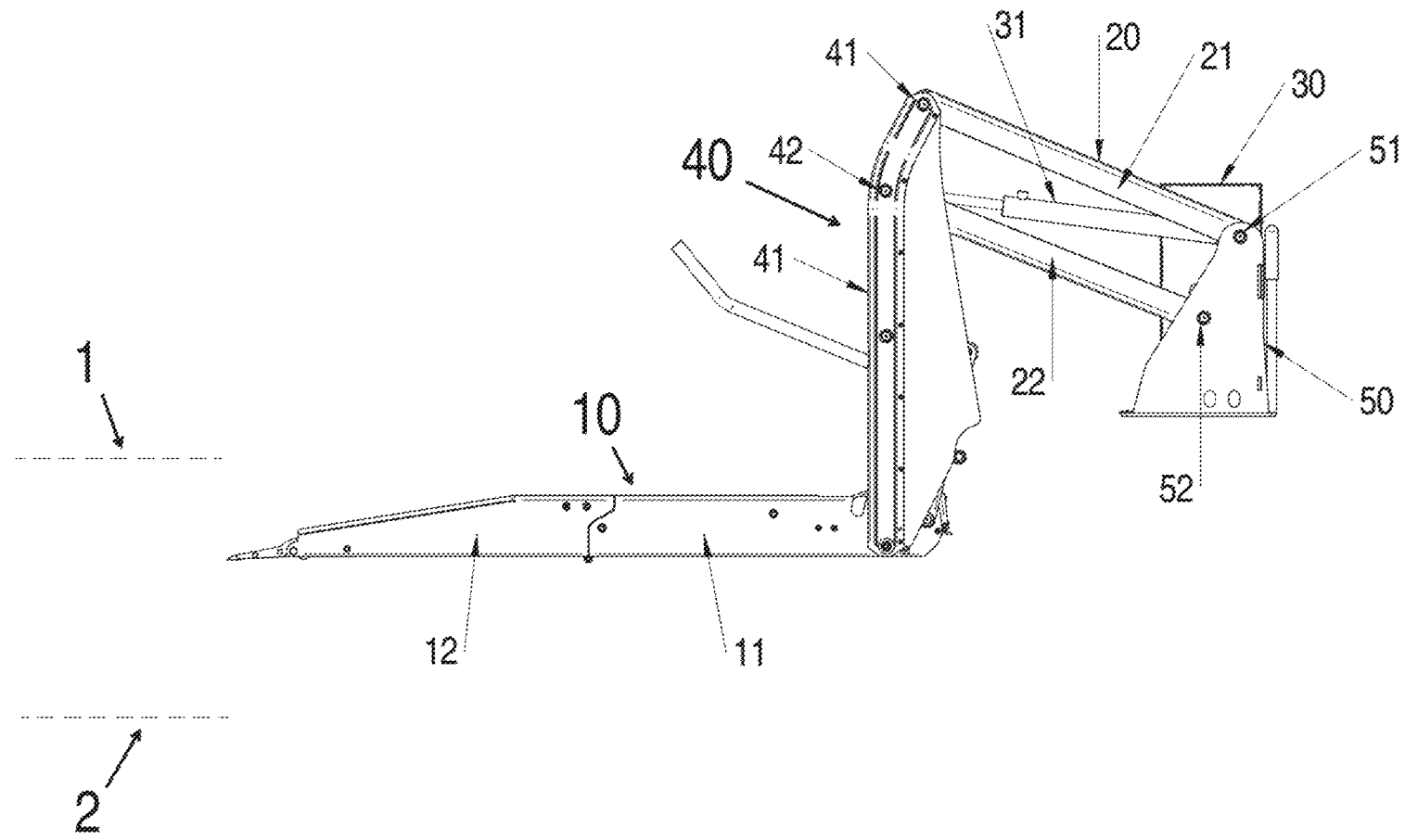
FIG. 1A shows a conventional embodiment of a wheelchair lift comprising straight lifting arms.
Figure 1B:
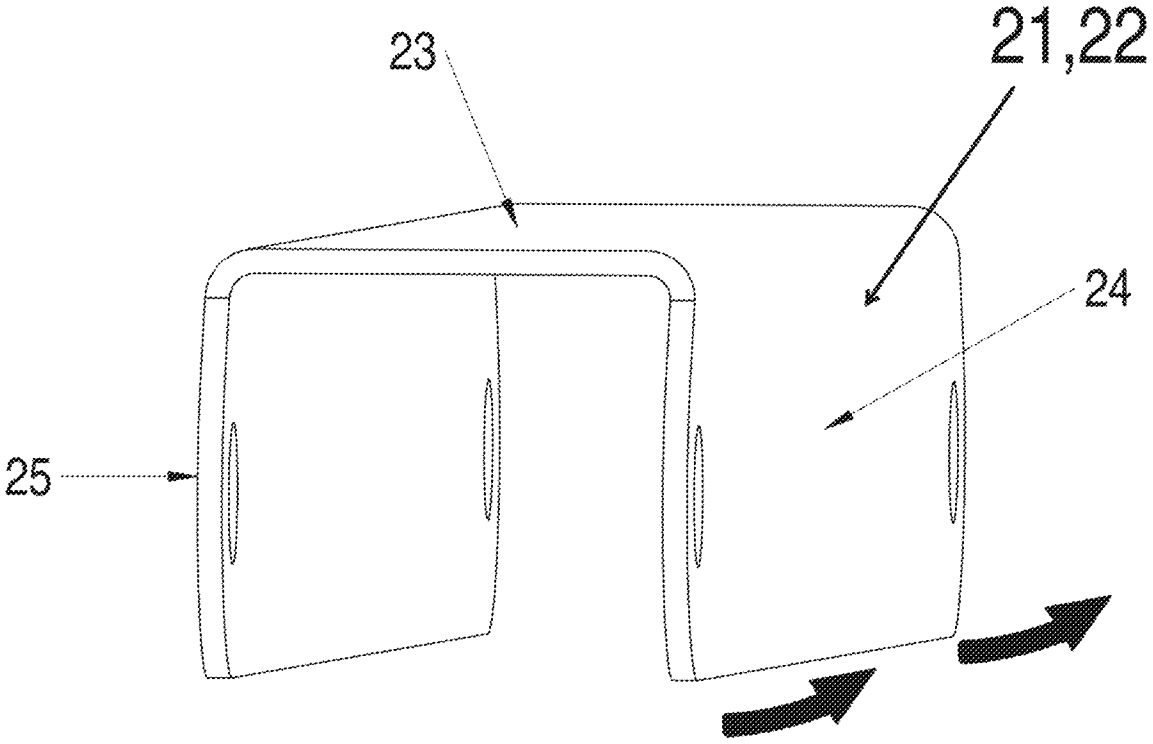
FIG. 1B shows a perspective cross-sectional view of a conventional straight lifting arms.
Figure 2A:
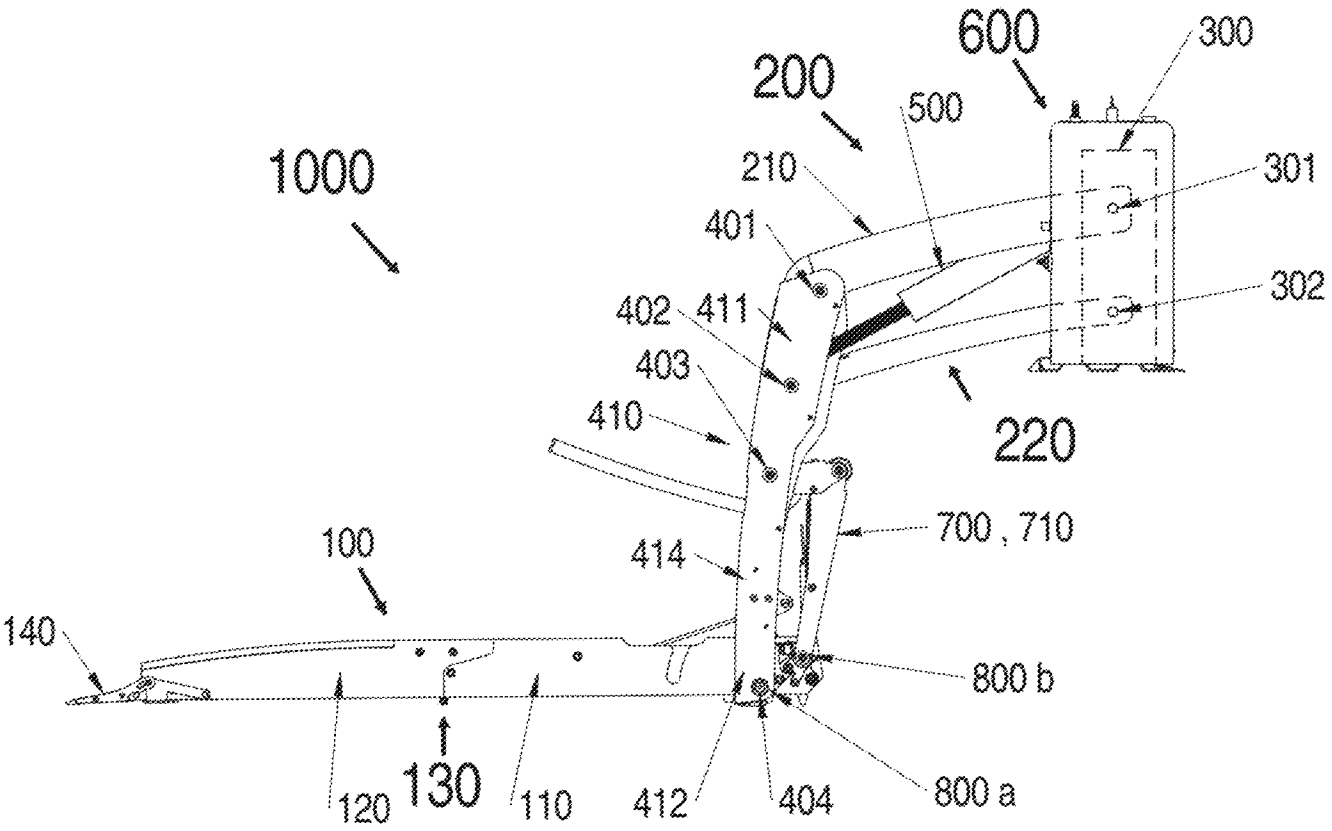
FIG. 2A shows an embodiment of a wheelchair lift having bent/curved lifting arms.
Figure 2B:
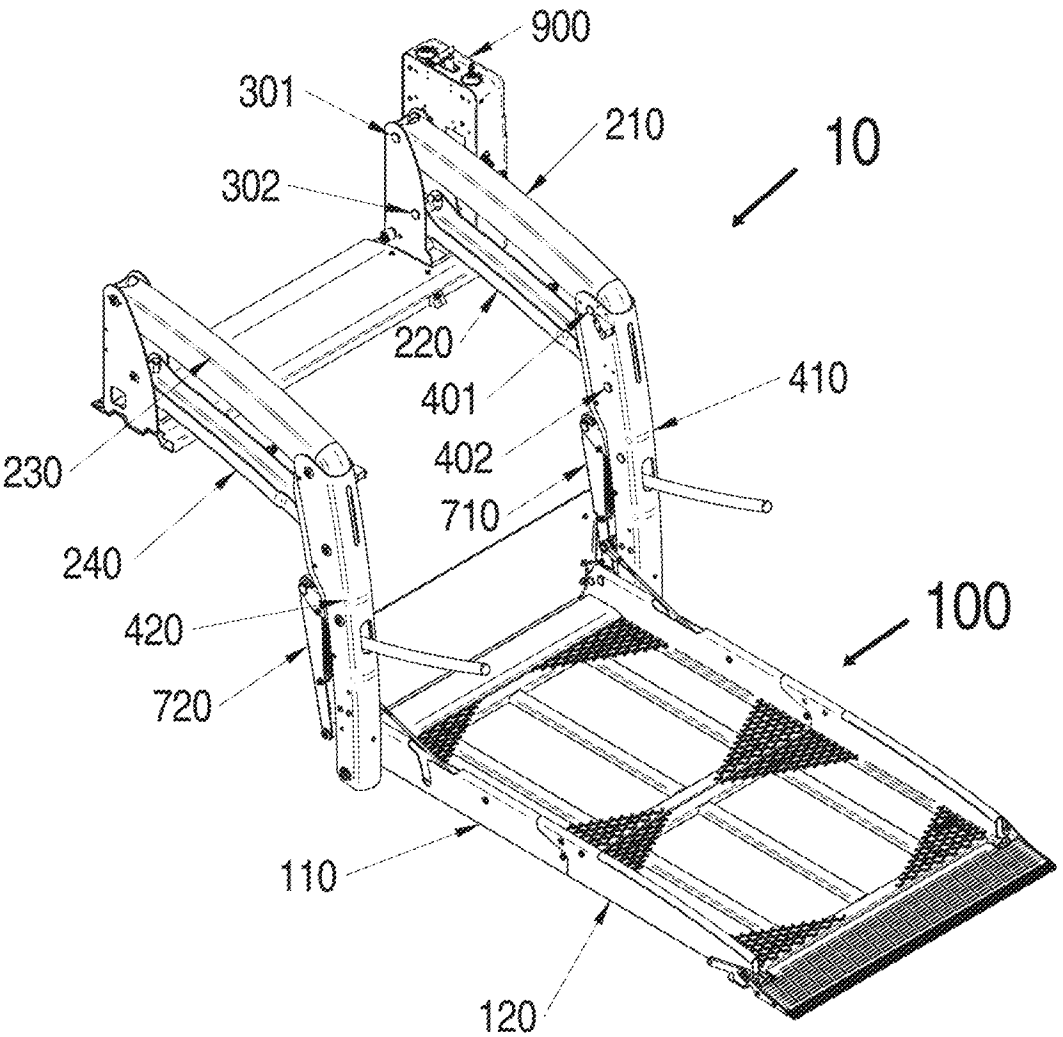
FIG. 2B shows a perspective view of an embodiment a wheelchair lift having bent/curved lifting arms.

FIG. 2A and FIG. 2B show an embodiment of a wheelchair lift 1000 to raise a wheelchair from a ground level position to an entry level position to enter a vehicle. The wheelchair lift 1000 comprises a platform assembly 100 to load the wheelchair. The platform assembly 100 comprises at least one plate having a platform to support the wheelchair. The platform assembly 100 may comprise a single plate being constructed as a component made in one piece.

According to an exemplified embodiment of the wheelchair lift 1000 illustrated in FIGS. 2A and 2B, the platform assembly 100 comprises an inner plate 110 and an outer plate 120 to support the wheelchair. The outer and inner plates 110, 120 are pivotably coupled by a hinged unit 130 which is arranged at the bottom side of the platform assembly 100 between the inner plate 110 and the outer plate 120. An outer roll stop means 140 is mounted to the end of the outer plate 120.

The wheelchair lift 1000 further comprises a lifting assembly 200 to move the platform assembly 100 between the entry level position and the ground level position which is below the entry level position. The wheelchair lift 1000 comprises a power control assembly 600 to control the movement of the platform assembly 100 between the ground level position and the entry level position. The power control assembly 600 is further configured to move the platform assembly 100 from the entry level position to a stowed position in which the inner and outer plates 110, 120 of the platform assembly are collapsed.

The wheelchair lift 1000 further comprises a supporting assembly 400 to movably hold the platform assembly 100. The supporting assembly 400 comprises a supporting arm 410 and a supporting arm 420. Each of the supporting arms 410, 420 comprises an upper and a lower portion. The respective upper portion of the supporting arms 410, 420 is pivotably coupled to the lifting assembly 200. The respective lower portion of the supporting arms 410, 420 is pivotably coupled to the platform assembly 100, particularly to the inner plate 110 of the platform assembly 100. The supporting arms 410, 420 may be pivotably coupled to the platform assembly 100 by a coupling device 800*a*. The coupling device 800*a* is configured to pivotably couple the platform assembly 100, particularly the inner plate 110 of the platform assembly 100, to the supporting arms 410, 420. The wheelchair lift 1000 further comprises an elbow assembly 700 comprising an elbow device 710 and an elbow device 720. The elbow devices 710 and 720 are pivotably coupled to a respective side panel of the inner plate 110 by a coupling device 800*b*.

The lifting assembly 200 comprises a pair of a first lifting arm 210 and a second lifting arm 220. The lifting assembly 200 further comprises a pair of a third lifting arm 230 and a fourth lifting arm 240. According to the embodiment of the wheelchair lift the pair of the third lifting arm 230 and the fourth lifting arm 240 is embodied in the same way as the pair of the first lifting arm 210 and the second lifting arm 220. In the following only the embodiment of the pair of the first lifting arm 210 and the second lifting arm 220 is described.

As shown in FIG. 2A, the first lifting arm 210 is rotatably coupled to a first mounting point 401 of the supporting arm 410 at a first end section 411 of the supporting arm 410. The second lifting arm 220 is rotatably coupled to a second mounting point 402 of the supporting arm 410 in the first end section 411 of the supporting arm 410. The second mounting point 402 is arranged in the first end section 411 of the supporting arm 410 closer to the platform assembly 100 than the first mounting point 401. The platform assembly 100 is rotatably coupled to a second end section 412 of the supporting arm 410. The second end section 412 is opposite to the first end section 411 of the supporting arm 410.

The wheelchair lift 10 comprises a supporting plate 300 to support the lifting assembly 200. The first lifting arm 210 is rotatably coupled to a third mounting point 301 at the supporting plate 300. The second lifting arm 220 is rotatably coupled to a fourth mounting point 302 at the supporting plate 300. The first lifting arm 210 has a bent shape along the longitudinal direction of the first lifting arm 210 extending between the first mounting point 401 and the third mounting point 301. Furthermore, the second lifting arm 220 has a bent shape along the longitudinal direction of the second lifting arm extending between the second mounting point 402 and the fourth mounting point 302. According to the embodiment of the wheelchair lift shown in FIG. 2A, a bent shape of the lifting arms means a curved profile of the lifting arms. According to a possible embodiment, the lifting arms 210 and 220 may have a bending radius between 2600 mm and 3400, preferably a bending radius of 3000 mm.

Figure 3A:
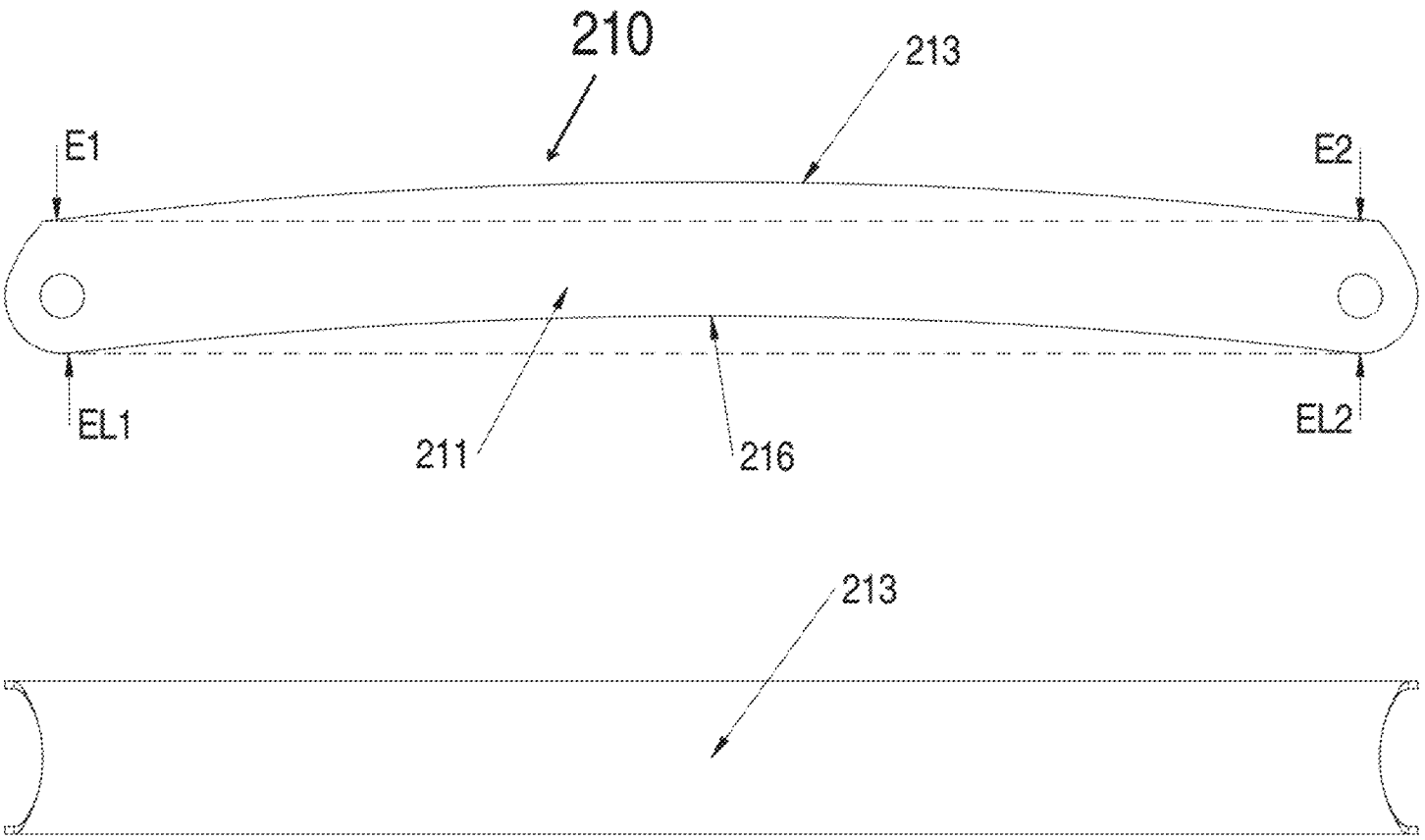
FIG. 3A shows a longitudinal view and a top view of a bent/curved lifting arm.
Figure 3B:
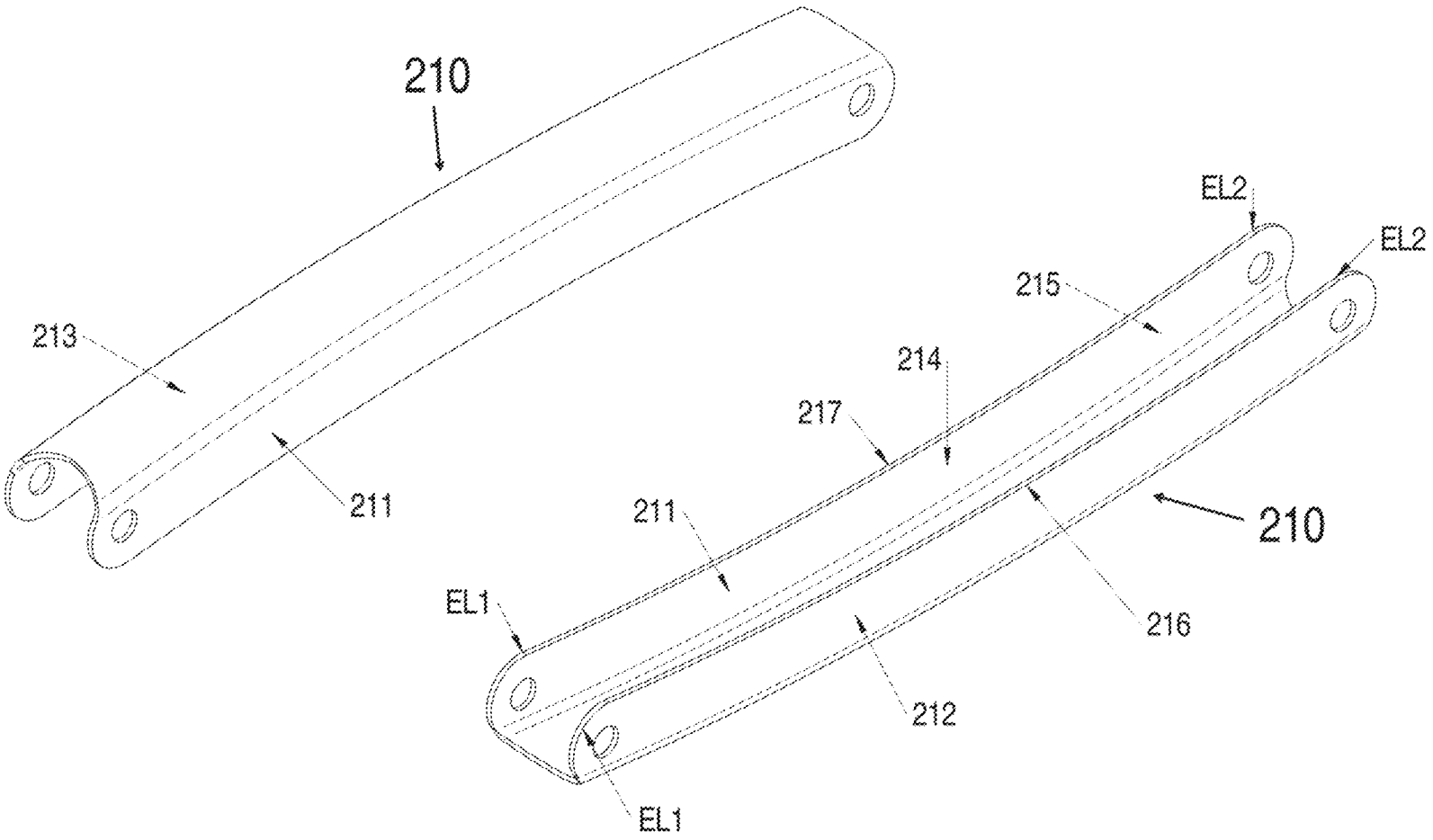
FIG. 3B shows a perspective view of a top and bottom surface of a bent/curved lifting arm.
Figure 3C:
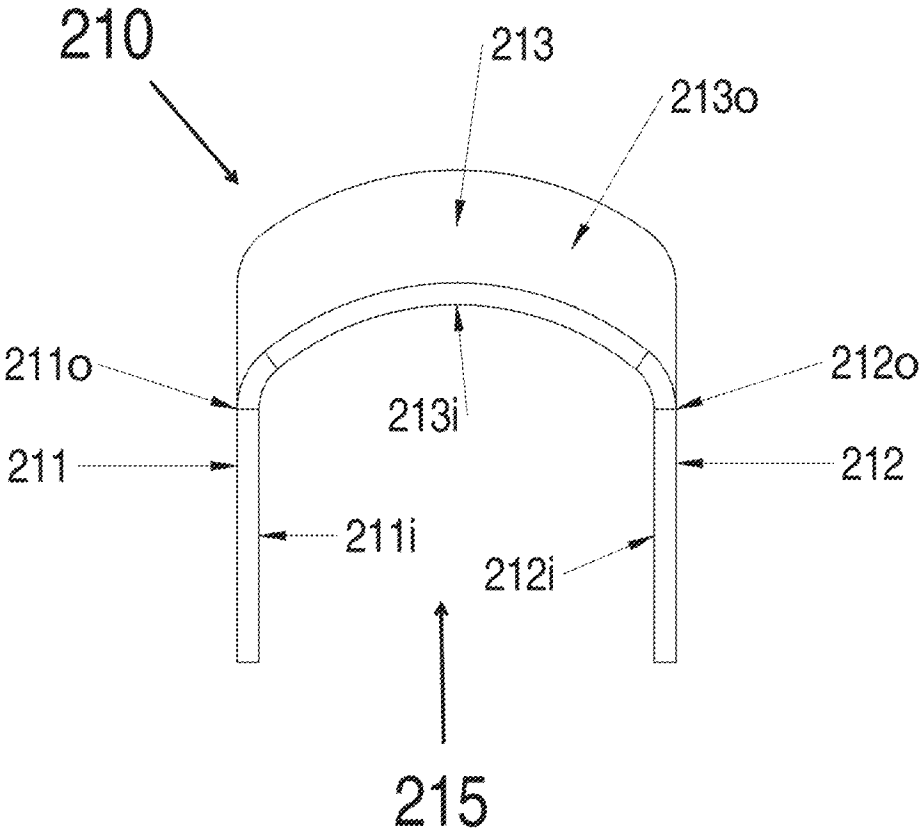
FIG. 3C shows a cross-sectional view of a bent/curved lifting arm.
Figure 4A:
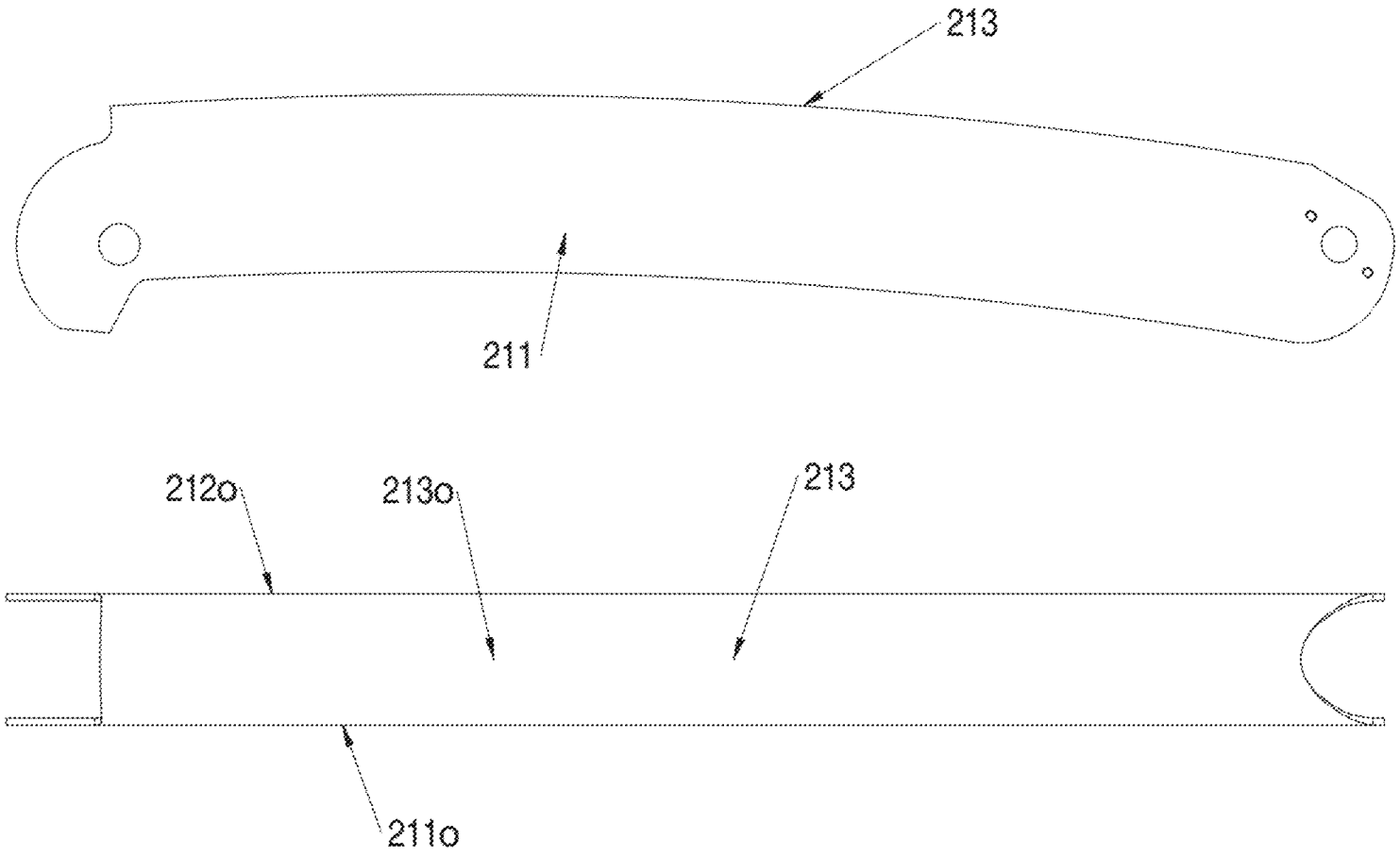
FIG. 4A shows a longitudinal view and a top view of a bent/curved lifting arm.
Figure 4B:
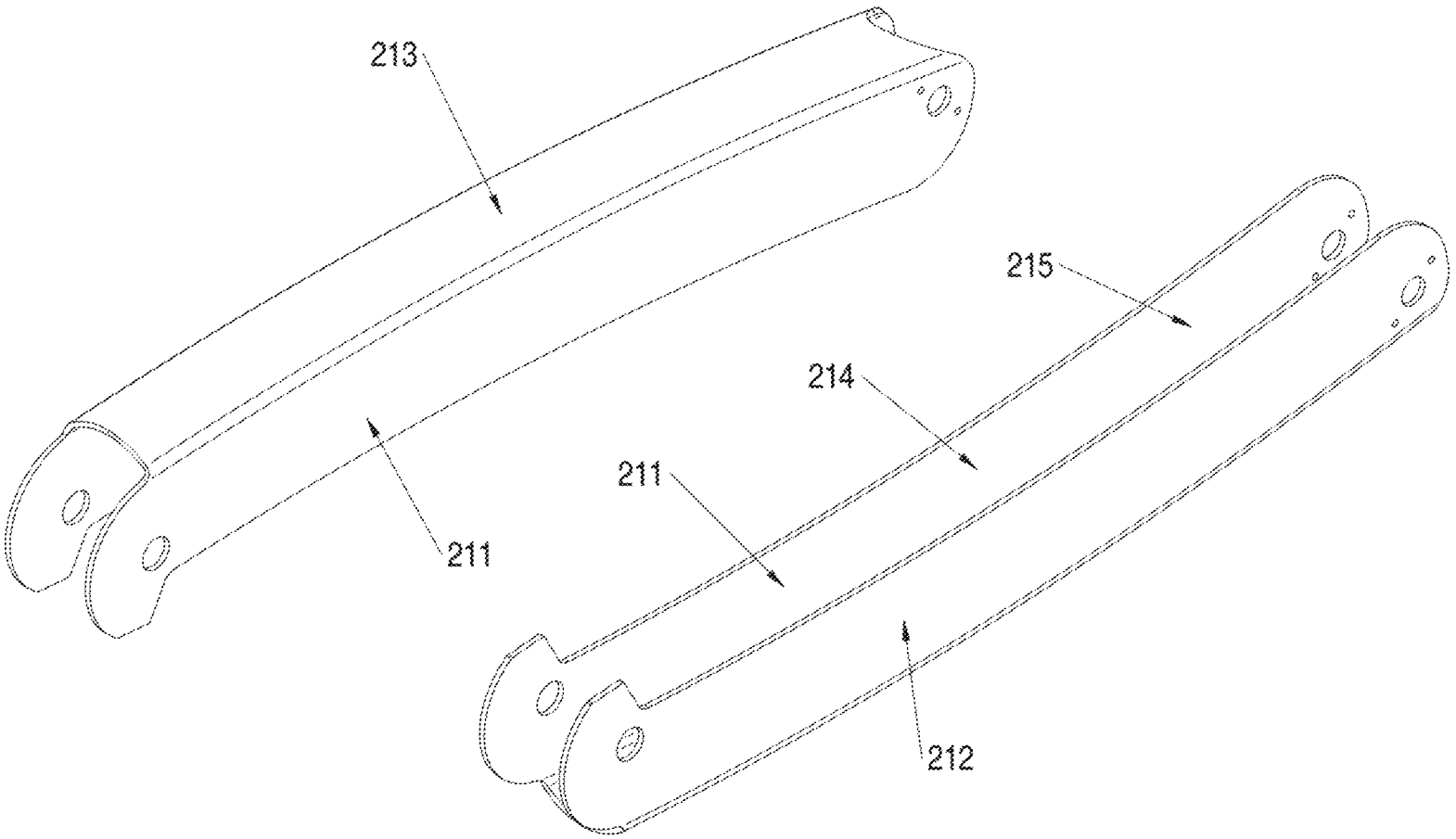
FIG. 4B shows a perspective view of a top and bottom surface of a bent/curved lifting arm.
Figure 5A:
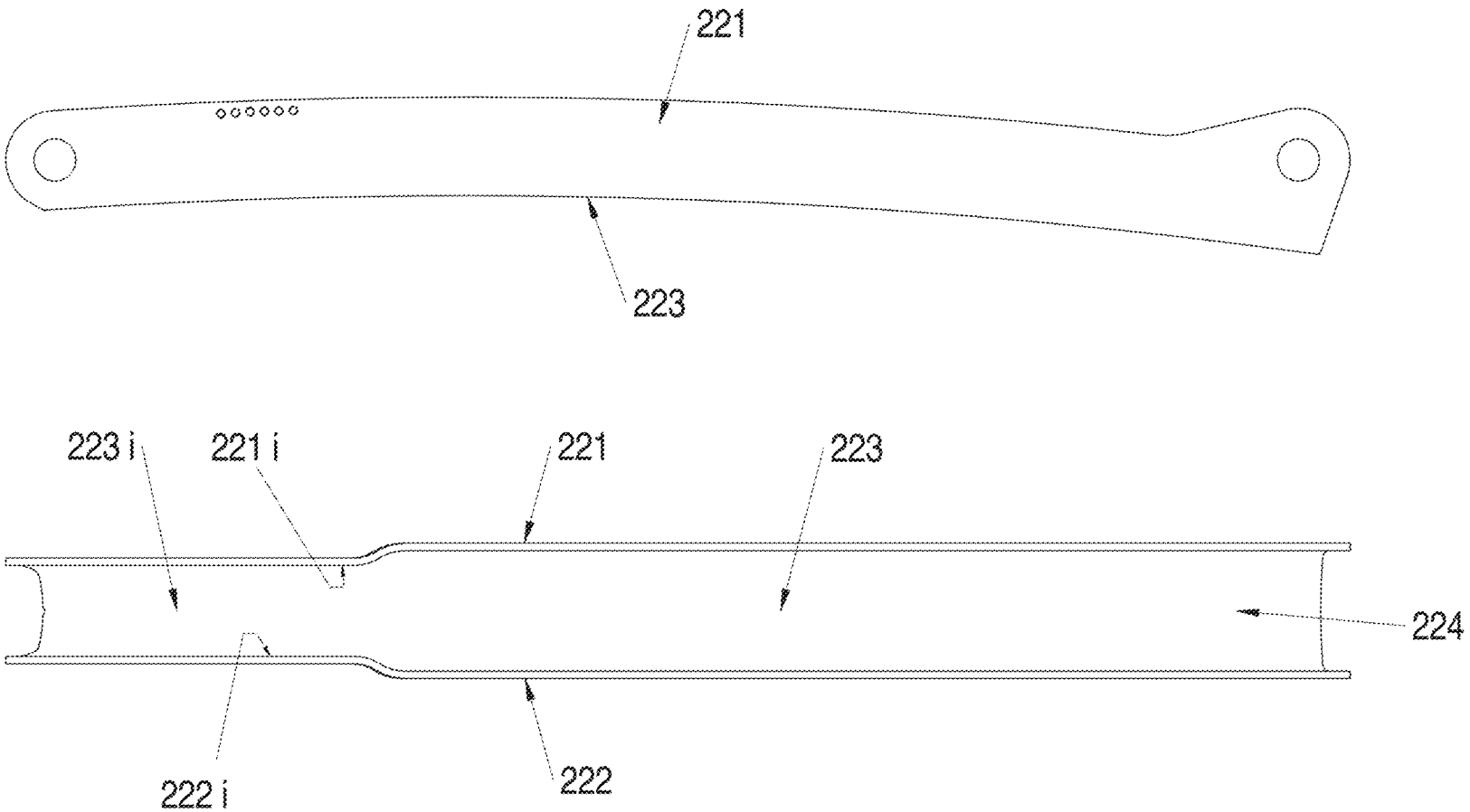
FIG. 5A shows a longitudinal view and a top view of a bent/curved lifting arm.
Figure 5B:
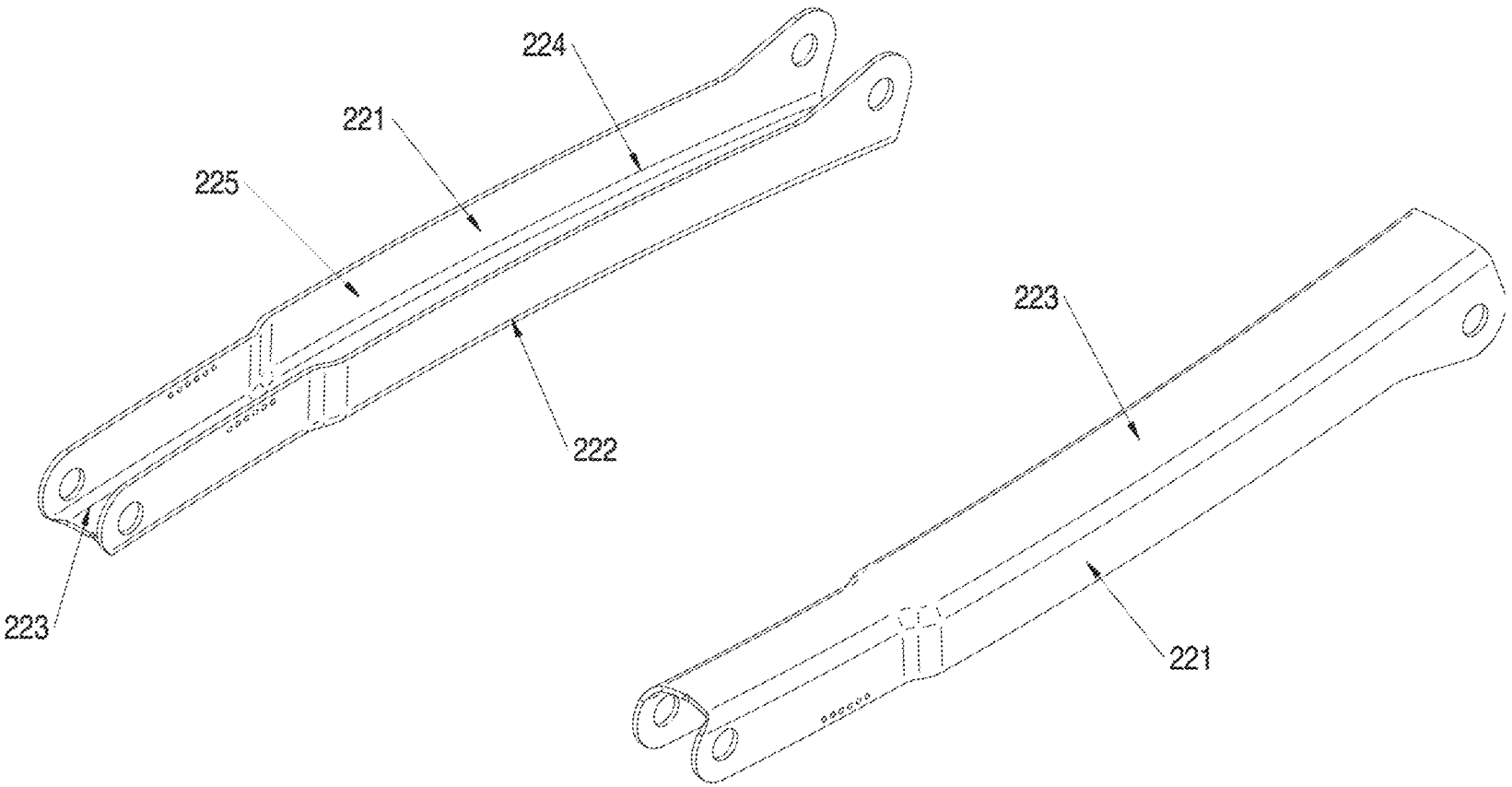
FIG. 5B shows a perspective view of a top and bottom surface of a bent/curved lifting arm.

A first embodiment of the wheelchair lift 1000 comprising a first embodiment of the lifting arms 210 and 220 is described in the following with reference to FIGS. 2A to 6. FIGS. 2A to 6 illustrate the first embodiment of the lifting arms 210 and 220 of the wheelchair lift 1000. It has to be noted that a first embodiment of the lifting arms 230 and 240 corresponds to the first embodiment of the lifting arms 210 and 220 described in the following. FIGS. 3A to 3C show different views of a first embodiment of a curved lifting arm. FIGS. 4A and 4B shows another embodiment of a bent/curved lifting arm 210, and FIGS. 5A and 5B shows another embodiment of a bent/curved lifting arm 220.

According to a possible embodiment of the wheelchair lift 1000 and the lifting arms 210 and 220, the first and the second lifting arms 210 and 220 may respectively be formed integrally, i.e. the first and the second lifting arms 210 and 220 are made of one piece.

According to a possible embodiment of the wheelchair lift 1000 and the first and second lifting arm 210 and 220, the first lifting arm 210 and the second lifting arm 220 may respectively have a U-shaped cross-sectional profile, as best shown in FIGS. 3B, 3C, 4B, 4C, and 5B, 5C.

As illustrated in FIGS. 3B, 3C, 4B, 4C and 5B, 5C, the first and second lifting arm 210 and 220 respectively have a bottom area/side 213, 223 and a first lateral area/side 211, 221 and a second lateral area/side 212, 222. The first lateral area 211, 221 of the first and second lifting arms 210, 220 is arranged orthogonally on a first side of the bottom area 213, 223 of the first and second lifting arms 210 and 220. The second lateral area 212, 222 of the first and second lifting arms is arranged orthogonally on a second side of the bottom area 213, 223 of the first and second lifting arms. The bottom area 213, 223 of the first and second lifting arm 210, 220 has a rounded shape between the first lateral area 211, 221 and the second lateral area 212, 222.

According to an embodiment of the wheelchair lift 1000 and the first lifting arm 210, the first lifting arm 210 has a first channel 214 formed between the bottom area 213 and the first and second lateral area 211, 212 of the first lifting arm 210. The first channel 214 of the first lifting arm 210 has an open side 215.

According to an embodiment of the wheelchair lift 1000 and the second lifting arm 220, the second lifting arm 220 has a second channel 224 formed between the bottom area 223 and the first and second lateral area 221, 222 of the second lifting area 220. The second channel 224 has an open side 225. As shown in FIGS. 2A and 2B, the first and the second lifting arms 210 and 220 are arranged such that the open side 225 of the first lifting arm 210 faces the open side 227 of the second lifting arm 220, as illustrated in FIG. 2A.

Figure 6:
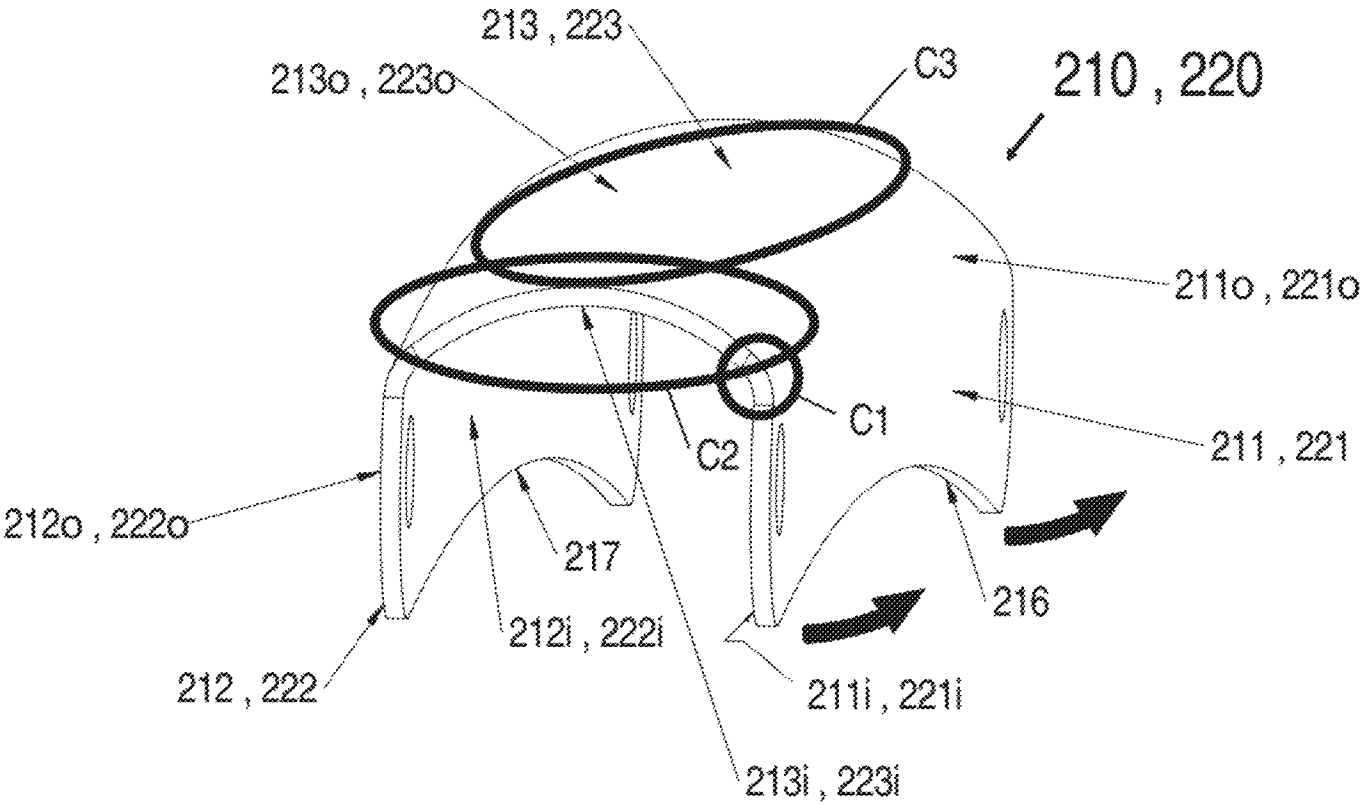
FIG. 6 illustrates curved/rounded areas of an embodiment of lifting arms.

According to an embodiment of the wheelchair lift 1000 and the first lifting arm 210, an outer surface 213*o* of the bottom area 213 of the first lifting arm 210 has a rounded shape between an outer surface 211*o* of the first lateral area 211 and an outer surface 212*o* of the second lateral area 212 of the first lifting arm 210. According to an embodiment of the wheelchair lift 1000 and the second lifting arm 220, an outer surface 223*o* of the bottom area 223 of the second lifting arm 220 has a rounded shape between an outer surface 2210 of the first lateral area 221 and an outer surface 222*o* of the second lateral area 222 of the second lifting arm 220. The rounded shape of the outer surface 213*o*, 223*o* of the bottom area 213, 223 of the first lifting arm 210 and the second lifting arm 220 is best shown in FIG. 6.

According to an embodiment of the wheelchair lift 1000 and the first lifting arm 210, an inner surface 213*i* of the bottom area 213 of the first lifting arm 210 has a rounded shape between an inner surface 211*i* of the first lateral area 211 and an inner surface 212*i* of the second lateral area 212 of the first lifting arm 210. According to an embodiment of the wheelchair lift 1000 and the second lifting arm 220, an inner surface 223*i* of the bottom area 223 of the second lifting arm 220 has a rounded shape between an inner surface 221*i* of the first lateral area 221 and an inner surface 222*i* of the second lateral area 222 of the second lifting arm 220.

According to an embodiment of the wheelchair lift 1000 and the first lifting arm 210, the bottom area 213 of the first lifting arm 210 has a bent shape along the longitudinal direction of the bottom area 213 of the first lifting arm 210 extending between the first mounting point 401 and the third mounting point 301. According to an embodiment of the wheelchair lift 1000 and the second lifting arm 220, the bottom area 223 of the second lifting arm 220 has a bent shape along the longitudinal direction of the bottom area 223 of the second lifting arm 220 extending between the second mounting point 402 and the fourth mounting point 302. A bent shape of the bottom area 213, 223 of the first and second lifting arms means a curved profile of the respective bottom area 213, 223.

According to an embodiment of the wheelchair lift 1000 and the first lifting arm 210, the first lateral area 211 and the second lateral area 212 of the first lifting arm 210 have a respective bent shape along the longitudinal direction of the first lateral area 211 and the second lateral area 212 of the first lifting arm 210 extending between the first mounting point 401 and the third mounting point 301. According to an embodiment of the wheelchair lift 1000 and the second lifting arm 220, the first lateral area 221 and the second lateral area 222 of the second lifting arm 220 have a respective bent shape along the longitudinal direction of the first lateral area 221 and the second lateral area 222 of the second lifting arm 220 extending between the second mounting point 402 and the fourth mounting point 302. A bent shape of the lateral areas 211, 212 and 221, 222 means a curved profile of the respective lateral areas of the first and second lifting arms.

According to an embodiment of the wheelchair lift 1000 and the first and second lifting arms, the first and the second lifting arm 210, 220 has a bent shape being formed such that the respective bottom area 213, 223 of the first and second lifting arm 210, 220 is located above a virtual straight line between a first end E1 of the respective bottom area 213, 223 and a second end E2 of the respective bottom area 213, 223 of the first and second lifting arm. The straight line between the first and second end E1, E2 is shown in FIG. 3A as a dashed line for the first lifting arm 210 and can also be applied to the second lifting arm 220.

According to an embodiment of the wheelchair lift 1000 and the first and second lifting arms, a peripheral edge 216, 226 of the respective first lateral area 211, 221 of the first and second lifting arm 210, 220 is located above a first virtual straight line extending between a first end EL1 and a second end EL2 of the peripheral edge 216, 226 of the first lateral area 211, 221 of the first and second lifting arm 210, 220. The second end EL2 is opposite to the first end EL1. The peripheral edge 216, 226 extends between the inner surface 211*i*, 221*i* and the outer surface 211*o*, 212*o* of the first lateral area. The first straight line between the first and second end EL1 and EL2 of the first peripheral edge 216, 226 is shown in FIG. 3A by a dashed line.

Furthermore, a peripheral edge 217, 227 of the respective second lateral area 212, 222 of the first and second lifting arm 210, 220 is located above a second virtual straight line extending between a first end EL1 and a second end EL2 of the peripheral edge 217, 227 of the second lateral area 212, 222 of the first and second lifting arm 210, 220. The second end EL2 is opposite to the first end EL1. The peripheral edge 217, 227 extends between the inner surface 212*i*, 222*i* and the outer surface 212*o*, 222*o* of the first lateral area.

According to an embodiment of the wheelchair lift 1000 and the first and second lifting arms 210 and 220, the wheelchair lift 1000 comprises at least one hydraulic cylinder 500 being arranged between the first lifting arm 210 and the second lifting arm 220 to move the supporting arm 410. The hydraulic cylinder 500 is shown in FIG. 2A. The lifting assembly 200 is configured to move the wheelchair lift in a stowed position. The at least one hydraulic cylinder 500 is disposed within the respective channel 214, 224 of the first and second lifting arm 210, 220, when the wheelchair lift 1000 is moved in the stowed position.

According to an embodiment of the wheelchair lift 1000 and the first lifting arm 210, the first lifting arm 210 has a continuously bent or curved shape along the longitudinal direction of the first lifting arm 210 extending between the first mounting point 401 and the second mounting point 301. According to an embodiment of the wheelchair lift 1000 and the second lifting arm 220, the second lifting arm 220 has a continuously bent or curved shape along the longitudinal direction of the second lifting arm 220 extending between the third mounting point 402 and the fourth mounting point 302.

The bent or curved shape of the lifting arms 210 and 220 allows to mount the lifting arms 210 and 220 at a relative low position on the supporting plate 300 without the risk of the second lifting arm 220 abutting on a vehicle bumper. If straight lifting arms would be used for the wheelchair lift, the lifting arms would have to be fixed to the supporting plate 300 at mounting points being above the mounting points 301 and 302 for the bent/curved lifting arms 210 and 220. As a result, the construction of the wheelchair lift 1000 is more stable with the bent or curved lifting arms 210 and 220 than with straight lifting arms. In conclusion, the bent or curved shape of the lifting arms 210 and 220 allows to mount the lifting arms at a low position of the supporting plate 300, wherein it can nevertheless be avoided that the lifting arm 220 touches the vehicle in which the wheelchair lift is mounted, when the platform assembly 100 is moved from the entry level position to the ground level position.

The curved lifting arms 210, 220, 230, 240 not only permit to have low fixing points at the supporting plate 300 but also to have a short length. For these reason the proposed configuration of the lifting arms allows to have a very compact lift that takes less space in a vehicle but can move as down as a lift with long (and unstable) arms. This feature permit to have a more compact and stable lift FIG. 6 illustrates a perspective view of the first and second lifting arms 210 and 220 with triple curved edges marked in FIG. 6 by the three circular/oval lines. The circle C1 marks a transition area between the bottom area 213, 223 and the lateral areas 211, 221 or 212, 222. As shown in FIG. 6 the transition area is configured as a rounded area. The circle C2 marks the rounded shape of the outer surface 213*o*, 223*o* of the bottom area 213, 223 of the first and second lifting arm 210, 220. The circle C3 indicates the bent or curved shape of the lifting arm 210 and 220 along the longitudinal direction of the lifting arms.

The embodiment of the lifting arms 210, 220 and 230, 240 with the triple curved edges as marked with the circles C1, C2 and C3 and as shown in FIGS. 3A to 6 allows to provide a wheelchair lift with increased strength and stability and improved rigidity. In particular, a twist of the lifting arms can be avoided by the proposed triple curved design, when a high load is placed on the platform assembly 100.

Figure 7A:
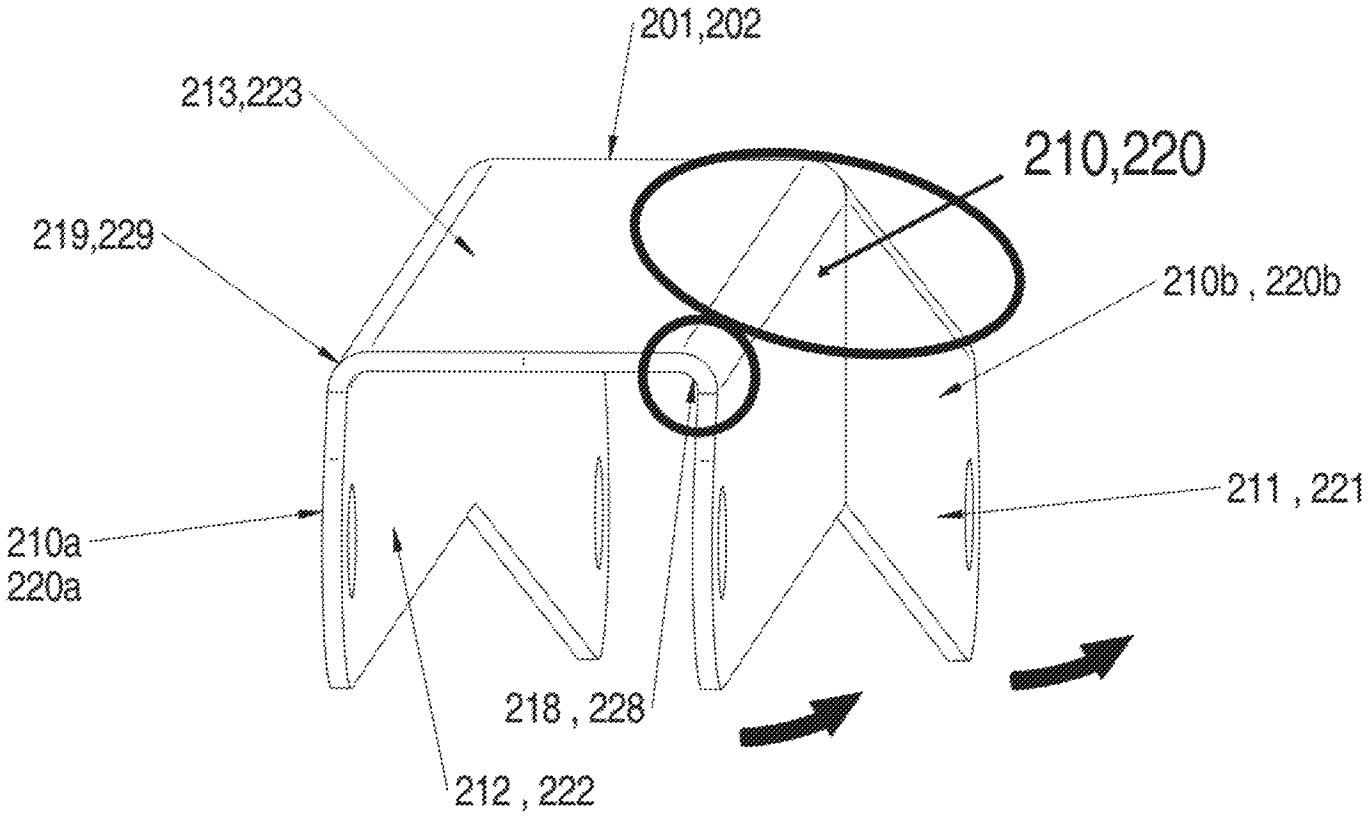
FIG. 7A illustrates a perspective view of an embodiment of a bent lifting arm.
Figure 7B:
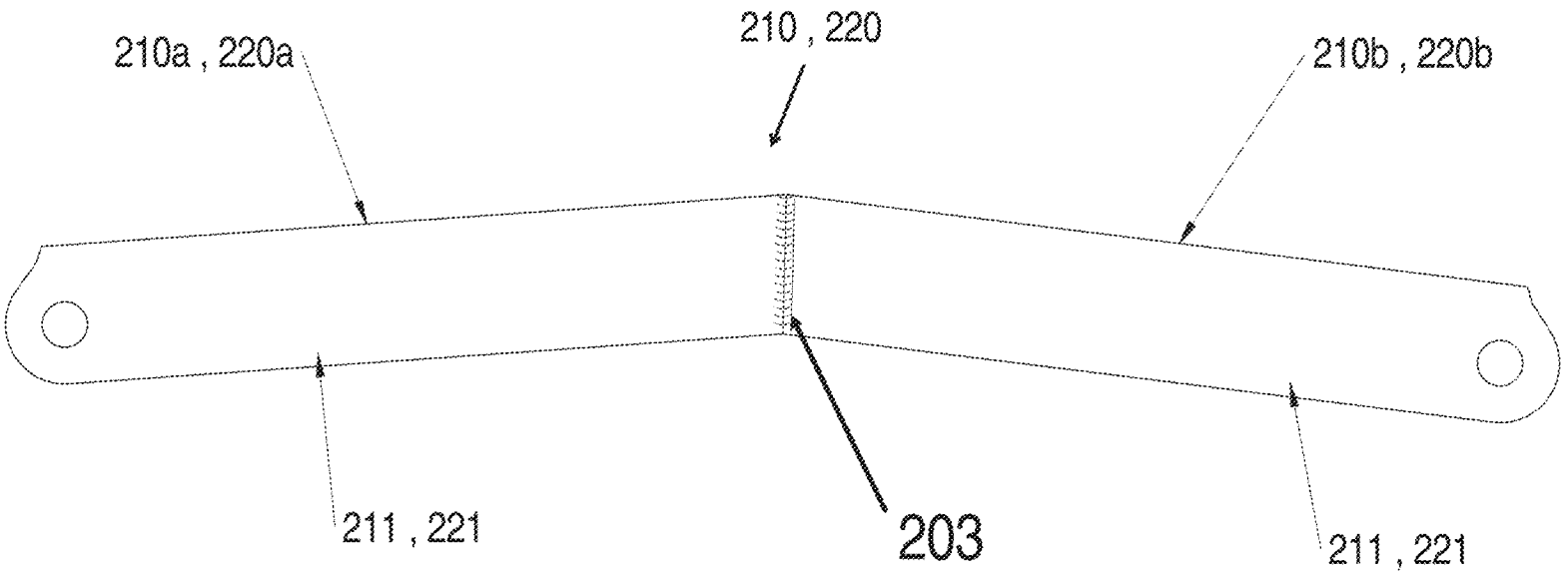
FIG. 7B shows a first longitudinal view of an embodiment of a bent lifting arm.

FIGS. 7A and 7B show another embodiment of the lifting arms 210 and 220 having a bent shape along their longitudinal direction. A bent shape here means a kinked profile. This embodiment of the lifting arms is explained in the following for the lifting arms 210 and 220 but is also valid for the lifting arms 230 and 240.

According to an embodiment of the wheelchair lift and the first lifting arm 210, the first lifting arm 210 has a first portion 210*a* and a second portion 210*b*. The first portion 210*a* and the second portion 210*b* of the first lifting arm 210 are arranged at an angle to each other such that an edge 201 is formed between the bottom area 213 of the first portion 210*a* and the bottom area 213 of the second portion 210*b* of the first lifting arm 210. The second lifting arm 220 has a first portion 220*a* and a second portion 220*b*. The first portion 220*a* and the second portion 220*b* of the second lifting arm 220 are arranged at an angle to each other such that a second edge 202 is formed between the bottom area 223 of the first portion 220*a* and the bottom area 223 of the second portion 220*b* of the second lifting arm 220.

According to an embodiment of the wheelchair lift and the first and second lifting arms shown in FIG. 7A, the first and the second lifting arm 210, 220 respectively have a first rounded area 218, 228 between the respective bottom area 213, 223 and the respective first lateral area 211, 221. The first and second lifting arm 210, 220 respectively have a second rounded area 219, 229 between the respective bottom area 213, 223 and the respective second lateral area 212, 222.

The circles C10 and C20 illustrate the curved and bent design of the embodiment of the lifting arms 210, 220 shown in FIG. 7A.

Figure 7C:
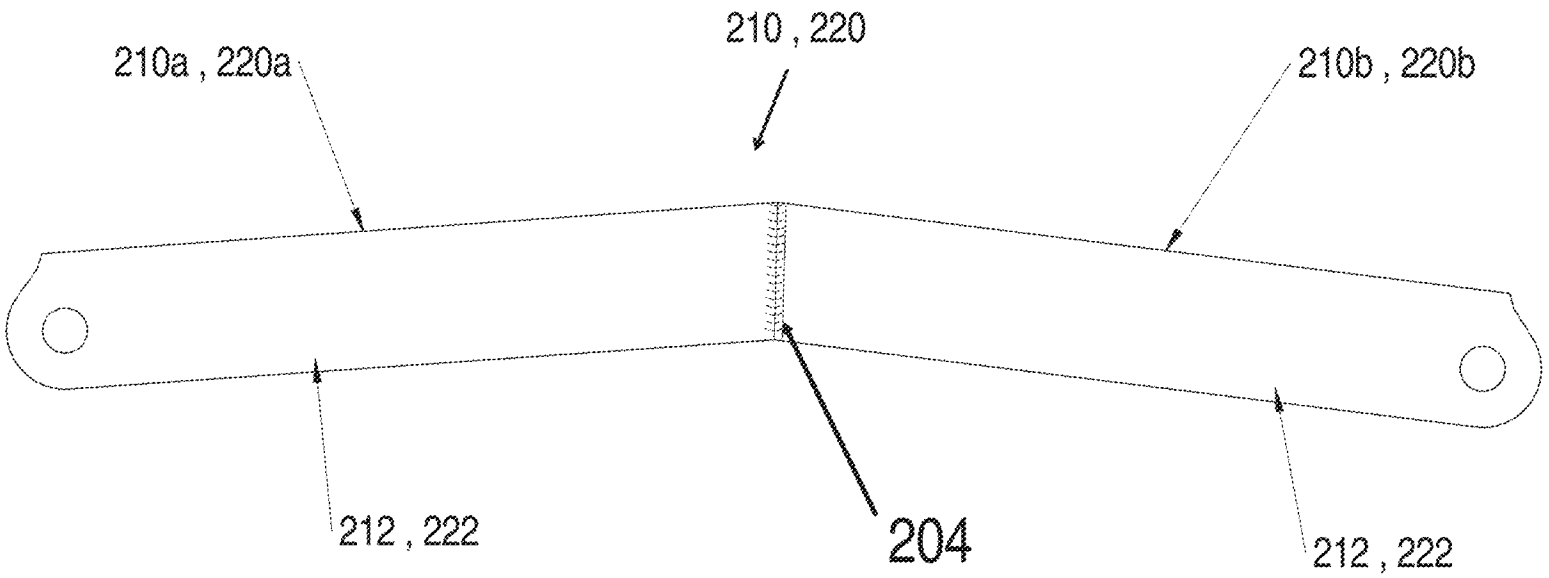
FIG. 7C shows a second longitudinal view of an embodiment of a bent lifting arm.

As shown in FIG. 7B, a respective first welded zone 203 is formed between the respective first lateral area 211, 221 of the first portion 210*a*, 220*a* of the first and second lifting arm 210, 220 and the respective first lateral area 211, 221 of the second portion 210*b*, 220*b* of the first and second lifting arms 210, 220. Furthermore, as shown in FIG. 7C, a respective second welded zone 204 is formed between the respective second lateral area 212, 222 of the first portion 210*a*, 220*a* of the first and second lifting arm 210, 220 and the respective second lateral area 212, 222 of the second portion 210*b*, 220*b* of the first and second lifting arm 210, 220.

In order to further strengthen the stability of the wheelchair lift, the supporting arms 410 and 420 may also be provided with a similar curved design as used for the lifting arms 210, 220, 230 and 240. The curved embodiment of the supporting arms 410 and 420 is described in the following with reference to FIG. 2A in relation to the supporting arm 410 but can also be applied to the supporting arm 420.

The supporting arm 410 has a curved shape/profile along its longitudinal direction between the first end section 411 and the second end section 412. In particular, the supporting arm 410 may be continuously curved along the longitudinal direction between the first end section 411 and the second end section 412 of the supporting arm. In particular, the supporting arm 410 is bent so that the outer profile, i.e. the outer surface 413 is curved with a constant radius of curvature. According to a possible embodiment, the supporting arms 410 and 420 may have a bending radius between 2600 mm and 3400, preferably a bending radius of 3000 mm. The supporting arm 410 may have a U-shaped profile.

The mounting points 401, 402, 403 and 404 are arranged in a side panel 414 of the supporting arm 410. In particular, the mounting points 401, . . . , 404 are placed on a virtual line being progressively bent or curved from the second end section 412 to the first end section 411 of the supporting arm 410.

A continuously curved embodiment of the supporting arms 410, 420 enables to further strengthen the stability of the wheelchair lift. In particular, the continuously curved design of the supporting arms 410, 420 allows to prevent a twisting of the supporting arms, when a high load is placed on the platform assembly 100, and, especially, when a high load is not placed in the platform center of the platform assembly 100.

The curved supporting arms permit to have a short length. For these reason the proposed configuration of the supporting arms allows to have a very compact and stable lift that takes less space in a vehicle but can move as down as a lift with long (and unstable) supporting arms.

The lifting arms 210, 220, 230 and 240 having the bent/curved design as shown in FIGS. 2A to 6, and the bent/curved supporting arms 410, 420 may be produced by deep drawing that is a cold forming process. To get this shape a powerful press will be necessary, because the die will have to work against the material strength not only for a limited surface, like for bending the conventional straight arms, but for big surfaces.

An advantage of cold forming is the work hardening. The material will get strengthened in the areas where its original shape will be modified.

LIST OF REFERENCE SIGNS

1 entry level position
2 ground level position
100 platform assembly
110 inner plate
120 outer plate
130 hinged unit
140 roll stop means
200 lifting assembly
210, . . . , 240 lifting arms
211, 221 first lateral area
212, 222 second lateral area
213, 223 bottom area
214, 224 first channel
215, 225 open side
216, 226 edge
217, 227 edge
218, 228 first rounded area
219, 229 second rounded area
300 supporting plate
301, 302 mounting points
400 supporting assembly
401, . . . , 404 mounting points
410, 420 supporting arms
500 hydraulic cylinder
600 power control assembly
700 elbow assembly
710, 720 elbow device
800*a*, 800*b* coupling device
1000 wheelchair lift

What is claimed is:

1. A wheelchair lift, comprising:

a platform assembly (100) to receive a wheelchair, a lifting assembly (200) to move the platform assembly (100) between an entry level position (1) and a ground level position (2) which is below the entry level position, a supporting plate (300) to support the lifting assembly (200), a supporting arm (410) to support the platform assembly (100), wherein the lifting assembly (200) comprises a pair of a first lifting arm (210) and a second lifting arm (220), wherein the first and the second lifting arm (210, 220) respectively have a bottom area (213, 223) and a first lateral area (211, 221) and a second lateral area (212, 222), wherein the first lateral area and the second lateral area are connected by the bottom area, wherein the first lifting arm (210) is rotatably mounted to a first mounting point (401) of the supporting arm (410) in a first end section (411) of the supporting arm (410), and the second lifting arm (220) is rotatably mounted to a second mounting point (402) of the supporting arm (410) in the first end section (411) of the supporting arm (410), the second mounting point (402) being arranged in the first end section (411) of the supporting arm (410) closer to the platform assembly (100) than the first mounting point (402), wherein the first lifting arm (210) is rotatably mounted at the supporting plate (300) by a third mounting point (301) of the supporting plate (300), and the second lifting arm (220) is rotatably mounted at the supporting plate (300) by a fourth mounting point (302) of the supporting plate (300), wherein the first lifting arm (210) has a bent shape along the longitudinal direction of the first lifting arm (210), and wherein the second lifting arm (220) has a bent shape along the longitudinal direction of the second lifting arm (220), wherein the bottom area (213) of the first lifting arm (210) has a bent shape along the longitudinal direction of the bottom area (213) extending between the first mounting point (401) and the third mounting point (301), and wherein the bottom area (223) of the second lifting arm (220) has a bent shape along the longitudinal direction of the bottom area (223) extending between the second mounting point (402) and the fourth mounting point (302).

2. The wheelchair lift of claim 1, wherein the first and the second lifting arms (210, 220) are respectively formed integrally.

3. The wheelchair lift of claim 1, wherein the first lifting arm (210) and the second lifting arm (220) respectively have a U-shaped cross sectional profile.

4. The wheelchair lift of claim 1, wherein the first lateral area (211, 221) is arranged orthogonally on a first side of the bottom area (213, 223) and the second lateral area (212, 222) is arranged orthogonally on a second side of the bottom area (213, 223), wherein the respective bottom area (213, 223) of the first and second lifting arm (210, 220) has a rounded shape between the first lateral area (211, 221) and the second lateral area (212, 222).

5. The wheelchair lift of claim 3, wherein an outer surface (213*o*) of the bottom area (213) of the first lifting arm (210) has a rounded shape between an outer surface (211*o*) of the first lateral area (211) and an outer surface (212*o*) of the second lateral area (212) of the first lifting arm (210), wherein an outer surface (223*o*) of the bottom area (223) of the second lifting arm (220) has a rounded shape between an outer surface (221*o*) of the first lateral area (221) and an outer surface (222*o*) of the second lateral area (222) of the second lifting arm (220).

6. The wheelchair lift of claim 3, wherein an inner surface (213*i*) of the bottom area (213) of the first lifting arm (210) has a rounded shape between an inner surface (211*i*) of the first lateral area (211) and an inner surface (212*i*) of the second lateral area (212) of the first lifting arm (210), wherein an inner surface (223*i*) of the bottom area (223) of the second lifting arm (220) has a rounded shape between an inner surface (221*i*) of the first lateral area (221) and an inner surface (222*i*) of the second lateral area (222) of the second lifting arm (220).

7. The wheelchair lift of claim 3, wherein the first lifting arm (210) has a first channel (214) formed between the bottom area (213) and the first and second lateral area (211, 212) of the first lifting arm, the first channel (214) having an open side (215), wherein the second lifting arm (220) has a second channel (224) formed between the bottom area (223) and the first and second lateral area (221, 222) of the second lifting area (220), the second channel (224) having an open side (225), wherein the first and the second lifting arm (210, 220) are arranged such that the open side (215) of the first lifting arm (210) faces the open side (225) of the second lifting arm (220).

8. The wheelchair lift of claim 3, wherein the first lateral area (211) and the second lateral area (212) of the first lifting arm (210) have a respective bent shape along the longitudinal direction of the first lateral area (211) and the second lateral area (212) extending between the first mounting point (401) and the third mounting point (301), wherein the first lateral area (221) and the second lateral area (222) of the second lifting arm (220) have a respective bent shape along the longitudinal direction of the first lateral area (221) and the second lateral area (222) extending between the second mounting point (402) and the fourth mounting point (302).

9. The wheelchair lift of claim 3, wherein the first and the second lifting arm (210, 220) has a bent shape being formed such that the respective bottom area (213, 223) of the first and second lifting arm (210, 220) is located above a virtual straight line between a first end (E1) of the respective bottom area (213, 223) and a second end (E2) of the respective bottom area (213, 223) of the first and second lifting arm (210, 220), the second end (E2) being opposite to the first end (E1), wherein a peripheral edge (216, 226) of the respective first lateral area (211, 221) of the first and second lifting arm (210, 220) is located above a first virtual straight line extending between a first end (EL1) and a second end (EL2) of the peripheral edge (216, 226) of the first lateral area (211, 221) of the first and second lifting arm (210, 220), the second end (EL2) being opposite to the first end (EL1), and wherein a peripheral edge (217, 227) of the respective second lateral area (212, 222) of the first and second lifting arm (210, 220) is located above a second virtual straight line extending between a first end (EL1) and a second end (EL2) of the peripheral edge (217, 227) of the second lateral area (212, 222) of the first and second lifting arm (210, 220), and below the first virtual straight line, the second end (EL2) being opposite to the first end (EL1).

10. The wheelchair lift of claim 3, comprising:

at least one hydraulic cylinder (500) being arranged between the first and the second lifting arm (210, 220) to move the supporting arm (410), wherein the lifting assembly (200) is configured to move the wheelchair lift (1) in a stowed position, wherein the at least one hydraulic cylinder (500) is disposed within the respective channel (214, 224) of the first and second lifting arm (210, 220), when the wheelchair lift (1000) is moved in the stowed position.

11. The wheelchair lift of claim 1, wherein the first lifting arm (210) has a continuously bent shape along the longitudinal direction of the first lifting arm (210) extending between the first and second mounting point (401, 301), wherein the second lifting arm (220) has a continuously bent shape along the longitudinal direction of the second lifting arm (220) extending between the third and fourth mounting point (402, 302).

12. The wheelchair lift of claim 3, wherein the first and the second lifting arm (210, 220) has a first portion (210*a*, 220*a*) and a second portion (210*b*, 220*b*), wherein the first portion (210*a*) and the second portion (210*b*) of the first lifting arm (210) are arranged in an angle to each other such that a first edge (201) is formed between the bottom area (213) of the first portion (210*a*) and the bottom area (213) of the second portion (210*b*) of the first lifting arm (210), wherein the first portion (220*a*) and the second portion (220*b*) of the second lifting arm (220) are arranged in an angle to each other such that a second edge (202) is formed between the bottom area (223) of the first portion (220*a*) and the bottom area (223) of the second portion (220*b*) of the second lifting arm (220).

13. The wheelchair lift of claim 12, wherein a respective first welded zone (203) is formed between the respective first lateral area (211, 221) of the first portion (210*a*, 220*a*) of the first and second lifting arm (210, 220) and the respective first lateral area (211, 221) of the second portion (210*b*, 220*b*) of the first and second lifting arm (210, 220), wherein a respective second welded zone (204) is formed between the respective second lateral area (212, 222) of the first portion (210*a*, 220*a*) of the first and second lifting arm (210, 220) and the respective second lateral area (212, 222) of the second portion (210*b*, 220*b*) of the first and second lifting arm (210, 220).

14. The wheelchair lift of claim 12, wherein the first and the second lifting arm (210, 220) respectively have a first rounded area (218, 229) between the respective bottom area (213, 223) and the respective first lateral area (211, 221), wherein the first and the second lifting arm (210, 220) respectively have a second rounded area (219, 229) between the respective bottom area (213, 223) and the respective second lateral area (212, 222).

* * * * *